United States Patent [19]

Reynolds

[11] Patent Number: 4,563,073

[45] Date of Patent: Jan. 7, 1986

[54] LOW MASS HEAT AND PRESSURE FUSER AND RELEASE AGENT MANAGEMENT SYSTEM THEREFOR

[75] Inventor: Scott D. Reynolds, Endwell, N.Y.

[73] Assignee: Xerox Corporation, Stamford, Conn.

[21] Appl. No.: 666,713

[22] Filed: Oct. 31, 1984

[51] Int. Cl.[4] ..... G03G 15/20

[52] U.S. Cl. ..... 355/3 FU; 355/14 FU; 219/216

[58] Field of Search ..... 355/3 FU, 14 FU, 3 BE, 355/16; 219/216

[56] References Cited

U.S. PATENT DOCUMENTS

| | | | |
|---|---|---|---|
| 3,964,431 | 6/1976 | Namiki | 118/60 |
| 4,095,886 | 6/1978 | Koeleman et al. | 355/3 FU |
| 4,279,496 | 7/1981 | Silverberg | 355/3 BE |
| 4,324,482 | 4/1982 | Szlucha | 355/3 FU |
| 4,348,102 | 9/1982 | Sessink | 355/3 FU X |
| 4,352,551 | 10/1982 | Iwao | 355/3 FU |
| 4,372,246 | 2/1983 | Azar et al. | 355/3 FU X |
| 4,378,152 | 3/1983 | Edwards et al. | 355/3 FU |
| 4,393,804 | 7/1983 | Nygard et al. | 355/3 FU X |
| 4,407,580 | 10/1983 | Hashimoto et al. | 355/3 BE X |
| 4,497,570 | 2/1985 | Bolte et al. | 355/3 BE X |

*Primary Examiner*—A. C. Prescott

[57] ABSTRACT

Heat and pressure fusing apparatus for fixing toner images. The fusing apparatus is characterized by the separation of the heat and pressure functions such that the heat and pressure are effected at different locations on a thin flexible belt forming the toner contacting surface. A pressure roll cooperates with a stationary mandrel to form a nip through which the belt and copy substrate pass simultaneously. The belt is heated such that by the time it passes through the nip its temperature together with the applied pressure is sufficient for fusing the toner images passing therethrough. A release agent management (RAM) system comprising low mass donor and metering rolls, one of which is in contact with the belt, applies silicon oil to the belt without unacceptably reducing the fusing capability of the belt.

26 Claims, 4 Drawing Figures

LOW MASS HEAT AND PRESSURE FUSER AND RELEASE AGENT MANAGEMENT SYSTEM THEREFOR

This invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate such as the solid Teflon outer surface or covering of the aforementioned arrangement.

In attempts to improve at least the perceived quality of the image fused or fixed by a heated roll fuser, such rolls have been provided with conformable surfaces comprising silicone rubber or Viton (trademark of E. I. DuPont for a series of fluoroelastomers based on the copolymer of vinylidene fluoride and hexafluoropropylene). As in the case of the Teflon coated fuser, oil release fluids such as silicone based oils have been applied to the surface of the silicone rubber or Viton to both minimize offsetting and to facilitate stripping. See, for example, U.S. Pat. No. 3,964,431. When the fuser system is one which provides for applying silicone oil to silicone rubber or Viton a low viscosity silicone oil (i.e. on the order of 100–1000 cs) has most commonly been employed.

Heretofore, it has been necessary with the foregoing type of fuser to heat the fuser not only when images are being fused but also during standby when images are not being fused. This is because of the long delay that would be required to elevate the fuser to a proper operating temperature if the heat supply were turned off during standby, the long delay being due to the relatively large mass that has to be brought up to the fusing temperature. Such delays would not be tolerated by the user even though operating the fuser in such a manner would eliminate a substantial waste of energy. Along with this saving of energy, there would also be a reduction in heat loading to the environment.

Elimination of fuser standby power has been accomplished in prior art devices such as flash fusers and cold pressure fusers. Both of these types of fusers, however, exhibit other drawbacks. For example, cold pressure fusers exhibit poor quality images. Flash fusers create undesirable effluents and they work very poorly with colored toners, especially the lighter colored ones. Also, the optical density of flash fused images is unsatisfactory.

Accordingly, I have provided, as disclosed herein, a heat and pressure fuser that can be satisfactorily operated without the employment of standby power. In order to accomplish this, I have provided a fuser which may be referred to as an "instant-on" fuser because it can be turned on when fusing is required and "instantly" (i.e. in 8–10 seconds) elevated to its fusing temperature. To this end, my fuser comprises a low mass endless belt which is entrained about a pair of mandrels. A pressure roll is supported for pressure engagement with an area of the belt to provide the necessary pressure for fusing. Rotation of the pressure roll also effects movement of the belt.

A heat source for elevating the temperature of the belt is operatively supported at a predetermined distance from the area of contact between the belt and pressure roll, the distance being such that the belt has sufficient time to rise to the proper fusing temperature prior to contacting the toner images. Thus, when copy substrates carrying toner images thereon pass through this area the images subjected are simultaneously to heat and pressure.

Application of release agent materials such as silicone oils has been accomplished in various prior art release agent management systems by the employment of roller members, the latter of which is preferred for use with fuser members which are coated with elastomeric materials such as silicone rubber or Viton.

While conducting my work with the aforementioned "instant-on" fuser, I discovered a problem with using conventional roller members for applying silicone oil to the fuser belt. The problem was that these types of rollers acted as a heat sink thereby bleeding enough heat from the belt to render it unsatisfactory for use as an "instant-on" fuser. I solved this problem by providing a low mass (i.e. thin-walled roller) donor roller in contact with the belt surface. It was then possible to apply the necessary release agent material to the belt surface without removing an unacceptable quantity of heat therefrom.

Figure 1:
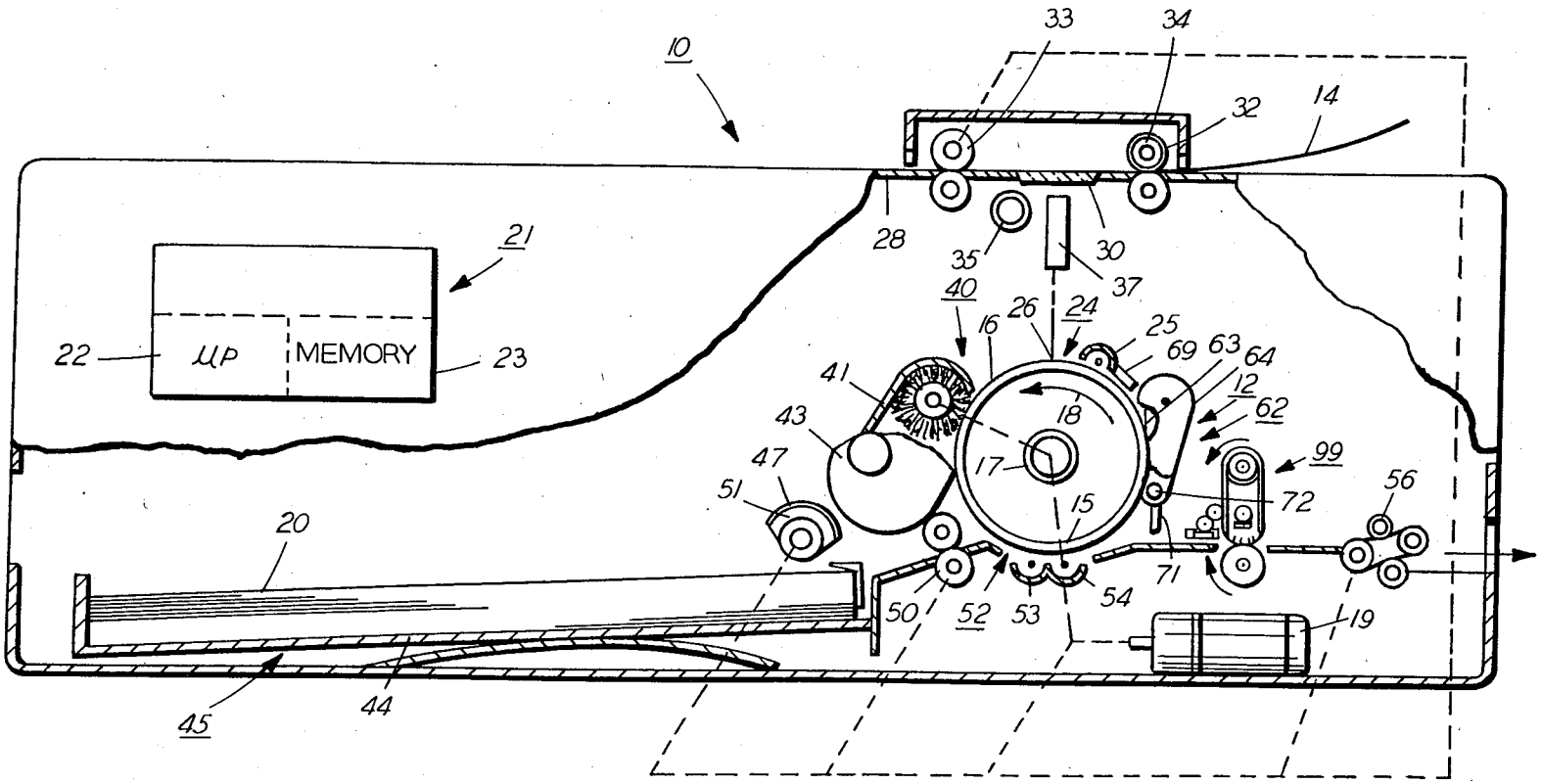
FIG. 1 is a side view depicting a xerographic reproduction machine or printer of the type adapted to incorporate the present invention.

Referring to FIG. 1 of the drawings, there is shown by way of example an automatic xerographic reproduction or printing machine, designated generally by the numeral 10 incorporating a fuser device 99 of the present invention.

The reproduction machine 10 depicted in FIG. 1 illustrates the various components utilized in machines of this type for producing copies of a document original 14. Although the device 99 of the present invention is particularly well adapted for use in reproduction machine 10, it should become evident from the following description that it is equally well suited for use in a wide variety of other reproduction and printing machine types and systems and is not necessarily limited in application to the particular embodiment of embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, suitable supporting surface or platen 28 for document original 14 is provided having a scan aperture or slit 30 therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37, which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image of the photoconductive surface 16 of photoreceptor 15 is developed at a development station 40. There, a suitable developer such as magnetic brush roll 41, which is drivingly coupled to main drive motor 19, brings suitable developer mix in developer housing 43 into developing elevation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet with the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 of photoreceptor 15. Registration roll pair 50 advance the copy sheet to transfer station 52. There suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57 where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Figure 2:
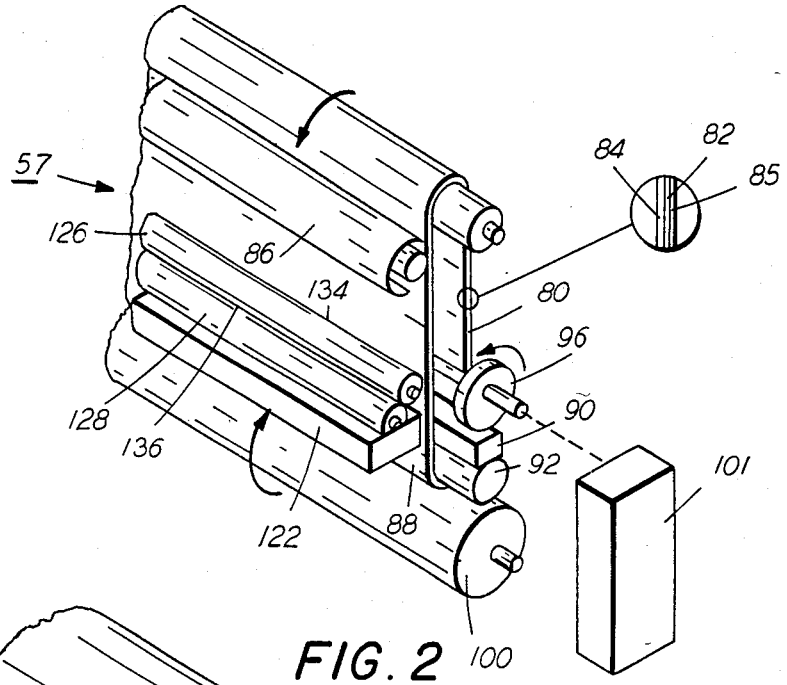
FIG. 2 is a perspective view of one embodiment of a fuser apparatus incorporating the inventive features of the invention.

Following transfer, residual developer remaining on the photoconductive surface 16 of photoreceptor 15 is removed at cleaning station 62 by means of cleaning blade 63 (FIG. 2). Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase device 69 is provided for this purpose.

At the cleaning station 62, the cleaning blade 63 is supported in contact with the photoreceptor 15 such that residual toner is chiselled therefrom.

The toner and debris that are removed from the photoreceptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 into a receptacle (not shown) which serves to store the residual toner until the receptacle is full after which it is removed from the machine.

Figure 3:
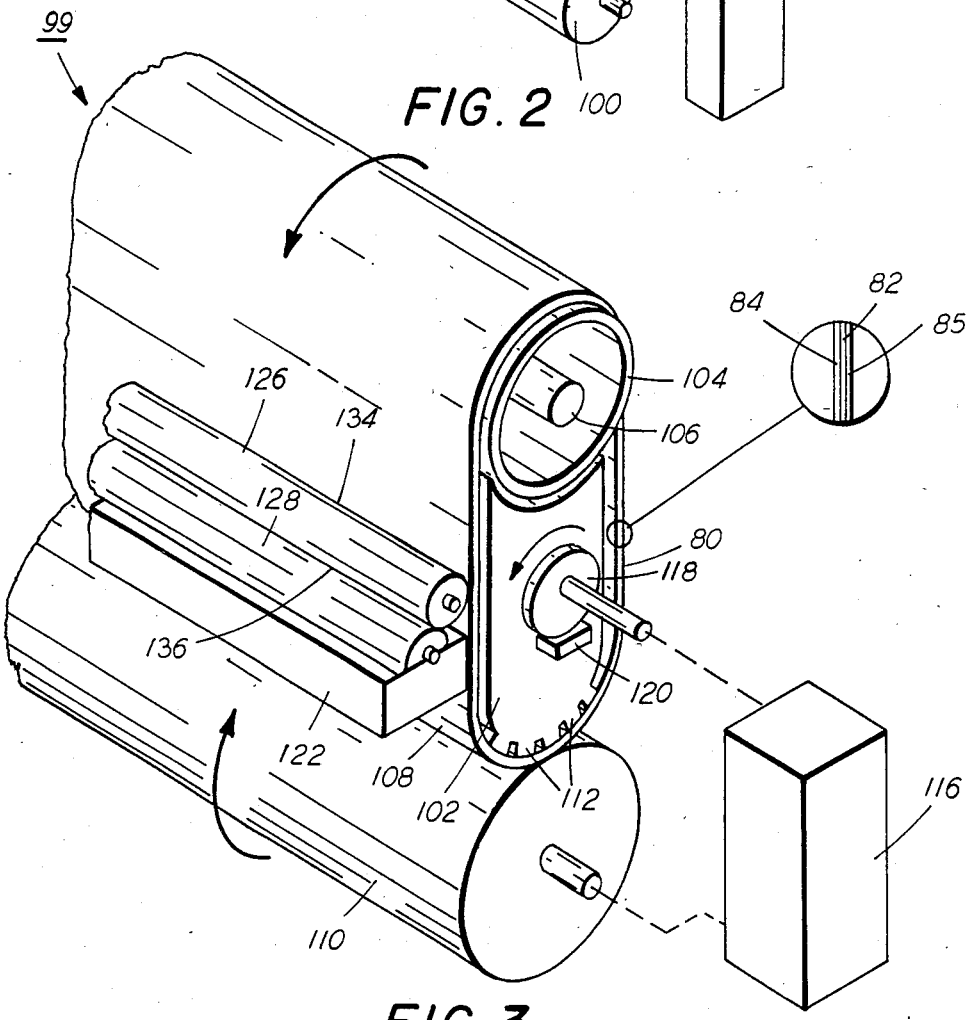
FIG. 3 is a side elevational view of another embodiment of a fuser apparatus incorporating the inventive features of the invention.

The inventive aspects of our invention will become apparent from a detailed discussion of FIGS. 2 and 3.

The fuser apparatus 57 disclosed in FIGS. 2 and 3 comprises a relatively thin fuser belt structure 80 comprising a base member 82 (FIG. 3) preferably fabricated from a metal material which is sufficiently stiff to be dragged across a non-rotating mandrel. To this end, the base member is fabricated from nickel by a conventional electroforming process which provides a uniform thickness in the order of 2–3 mils. The outer surface of the base member is coated with a conformable layer 84 which preferably comprises silicone rubber. The inner surface of the base member 82 is preferably coated with a low friction material 85 such as polytetrafluoroethylene, commonly known by the tradename Teflon (registered trademark of E. I. DuPont). The thickness of the conformable layer is preferably at least 5 mils.

The belt structure is heated by a radiant heater 86 to a temperature suitable for fusing toner images carried by copy sheets 20. The radiant heater 86 is positioned at a predetermined distance away from a nip area 88 through which the copy sheets pass with the conformable layer 84 contacting the toner images on the sheets. This distance between the nip area and the fuser is such that the heated portion of the belt contacts the toner images before the temperature of the belt has time to drop to a non-fusing temperature.

Because the belt structure is relatively thin, it is incapable of creating adequate nip pressures for fusing by the simultaneous application of heat and pressure. Accordingly, there is provided a rigid pressure rod 90 for creating the required pressure in the nip area. The rod 90 is supported in engagement with one of two mandrels 92 and 94 about which the belt is entrained. A suitable force applying device such as a cam 96 is provided for effecting pressure engagement of the rod 90 and the mandrel 92 which, in turn, cooperate with pressure roll 100 to create the desired pressure on the belt and toner images sandwiched between the mandrel 92 and the pressure roll. The cam is designed to apply a loading in the nip area 88 of approximately 200 pounds or 70–100 PSI. A suitable drive represented schematically by the reference character 101 serves to drive the pressure roll 100 which, in turn, frictionally effects movement of the belt about the mandrels. The drive 101 also effects intermittent operation of the cam 96.

The belt structure 80 and radiant heater 86 form a low (i.e. less than 150 grams and preferably 80 grams) mass fuser which can be elevated to an operating level in 6–8 seconds while operating at fusing speeds from 10–12 in/sec or any other desired speed. For such operating conditions, the power rating of the radiant energy source 86 is in the order of 1500–2000 watts. The belt structure in its non-tensioned condition preferably has a diameter of $2\frac{1}{2}$ inches and a width of 13 inches or greater.

An embodiment of my fuser apparatus represented by the reference character 99 in FIG. 3 also comprises the fuser belt structure 80. The belt structure is entrained about a stationary mandrel 102 and a thin-walled, rotationally supported tube heater 104, the latter of which has an internal source of energy 106 for elevating the temperature of the belt. A nip 108 is formed between the belt surface and a pressure roll 110. The mandrel has appended thereto a plurality of insulating nubs 112 to minimize the heat loss from the belt. Rotation of the pressure roll in a manner similar to that for rotating conventional roll fusers causes the belt to move about the mandrel whereby a heated portion of the belt is brought into the nip for fusing in toner images. In this embodiment, the belt structure, tube heater 104, and the internal heat source 106 form low mass fuser. A suitable structure (not shown) effects proper rack of the belt structure 80.

The tube heater 104 is preferably fabricated from nickel and has a thickness of approximately four mils. The preferred method of forming the tube heater is by the electroforming process. Thus, a structure that is relatively rigid and substantially uniform in thickness is provided. Since the tube heater rotates, sliding friction between the belt structure and the tube heater is avoided when movement of the belt structure is effected by the pressure roll. The pressure roll in both embodiments of the invention has an outside diameter of three inches. The outer surface of the pressure roll is provided with a relatively thick conformable layer which may comprise silicone rubber. Bearings (not shown) support the tube heater for rotation by means of a drive schematically represented by reference character 116. The drive 116 also serves to actuate the cam 118 which engages a cam follower 120 for applying a load on the mandrel 102 for creating the desired pressure in the nip 108.

While the layer 84 tends to be abhesive, therefore, exhibits a low affinity for the toner material, it has been found desirable to coat the layer with a release agent material 121 contained in a sump 122. The material 121 comprises a polymeric release agent having functional groups such as carboxy, hydroxy, epoxy, ammo, isogenate, thioether or mercepto groups.

Figure 4:
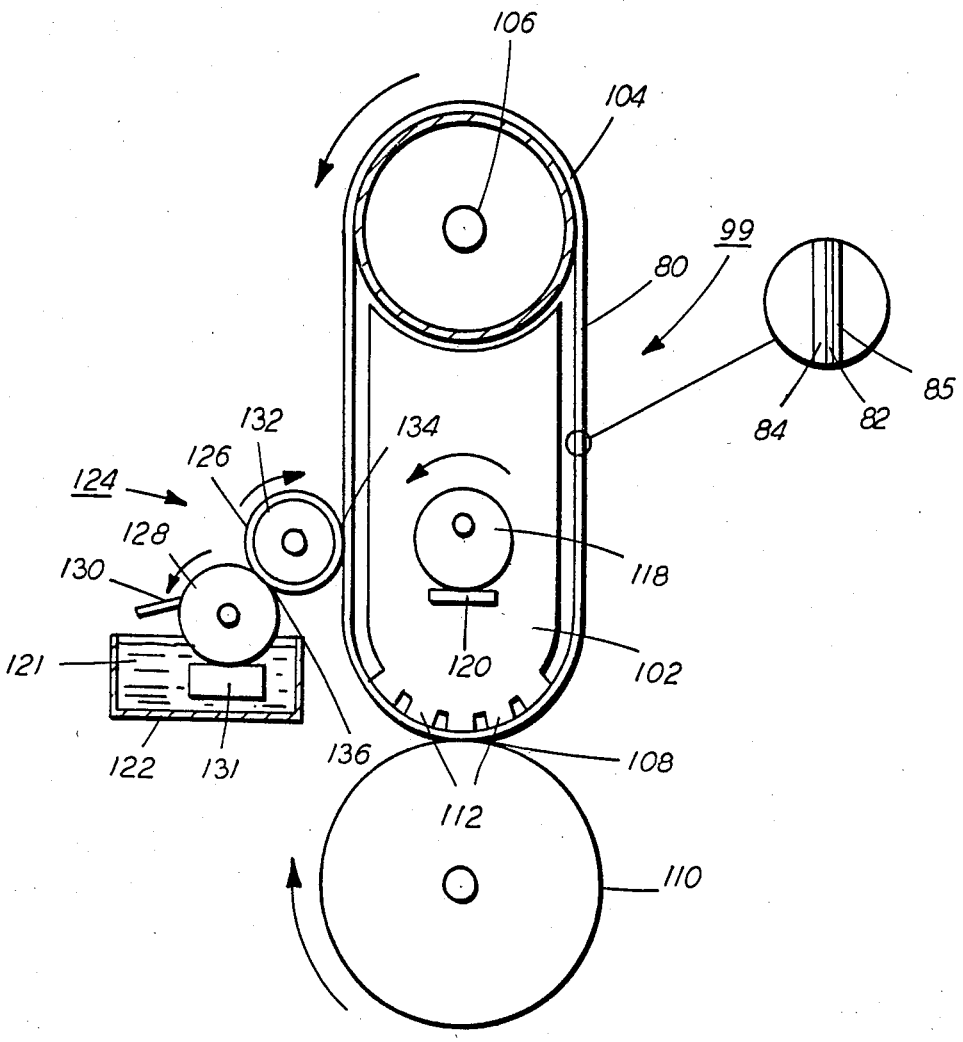
FIG. 4 is a perspective view of a low mass fuser incorporating a release agent management system of the invention.

For the purpose of coating the heated belt structure 80, there is provided a release agent management (RAM) system generally indicated 124 (FIG. 4). The mechanism 124 comprises a donor roll 126, metering roll 128, doctor blade 130, and a wick 131.

The metering roll 128 is partially immersed in the release agent material 121 and is supported for rotation such that it is contacted by the donor roll 126 which, in turn, is supported so as to be contacted by the heated belt structure 80. As can be seen, the orientation of the rolls is such as to provide a path for conveying material 121 from the sump to the surface of the heated belt structure 80. The metering roll is preferably a steel-surfaced roll having a 4-32 AA finish. The metering roll has an outside diameter of 0.75 inch. As mentioned above, the metering roll is supported for rotation, such rotation being derived by means of the positively driven heated belt structure 80 via the rotatably supported donor roll 126. In order to permit rotation (at a practical input torque to the heated belt structure 80) of the metering roll 128 in this manner the donor roll 126 comprises a deformable layer 132 which forms a first nip 134 between the metering roll and the donor roll and a second nip 136 between the latter and the heated belt. The nips also permit satisfactory release agent transfer between the rolls and belt structure. Suitable nip lengths are 0.10 inch.

The wick 131 is fully immersed in the release agent and contacts the surface of the metering roll 128. The purpose of the wick is to provide an air seal which disturbs the air layer formed at the surface of the roll 128 during rotation thereof. If it were not for the function of the wick, the air layer would be coextensive with the surface of the roll immersed in the release agent thereby precluding contact between the metering roll and the release agent.

The doctor blade 130, preferably fabricated from Viton, is $\frac{3}{4}\times\frac{1}{8}$ inch cross section and has a length coextensive with the metering roll. The edge of the blade contacting the metering roll has a radius of 0.001–0.010 inch. The blade functions to meter the release agent picked up by the roll 128 to a predetermined thickness, such thickness being of such a magnitude as to result in several microliters of release agent consumption per copy.

The donor roll 126 has an outside diameter of 0.813 inch when the metering roll's outside diameter equals 0.75 inch. It will be appreciated that other dimensional combinations will yield satisfactory results. For example, 1.5 inch diameter rolls for the donor and metering rolls have been employed. The deformable layer 128 of the donor roll preferably comprises silicone rubber. However, other materials may also be employed.

The two rolls 126 and 128 form a low mass release agent management system. To this end, the rolls are fabricated as thin-walled (i.e. approximately 5 mils) nickel material members by electroforming into the desired configuration. Accordingly, a low mass RAM system is provided which allows uniform release agent applications without contacting the belt structure with a large mass which would act as a heat sink.

As may now be appreciated from the foregoing, by separating the heating and pressure application functions, I have provided a fuser that has a very fast warmup time. Consequently, the fuser apparatus representing my invention can be operated at relatively high (i.e. 10–12 inches/sec.) speeds without the use of standby power. By providing a low mass RAM system which prevents excess heat removal from the fuser belt structure, the "instant-on" nature of my fuser is not adversely affected.

I claim:

1. Heat and pressure fuser apparatus for fixing powder images to substrates, said apparatus comprising:

a low mass endless belt structure;

means cooperating to form a nip with said belt structure and simultaneously apply pressure to said belt structure;

means remote from said pressure applying means for elevating the temperature of said belt whereby said powder images are simultaneously subjected to heat and pressure as said substrates pass through said nip, said means for elevating the temperature of said belt being in contact with said belt;

means for effecting movement of said belt structure through said nip; and a low mass release agent management system contacting said belt structure for applying release agent material without adversely affecting the fusing capability thereof.

2. Apparatus according to claim 1 wherein said means for elevating the temperature of said belt structure comprises a rotatable low mass tubular member having a source of energy disposed internally thereof.

3. Apparatus according to claim 2 wherein said means cooperating to apply pressure to said belt structure comprises a non-rotating mandrel.

4. Apparatus according to claim 3 including means disposed intermediate said belt structure and said non-rotating mandrel for minimizing the transfer of heat from the former to the latter.

5. Apparatus according to claim 4 wherein the surface of said belt structure contacting said powder images comprises a conformable layer.

6. Apparatus according to claim 5 wherein said belt structure is coated with a low friction material which contacts said non-rotating mandrel and said tubular member.

7. Apparatus according to claim 2 wherein the geometry of the mandrel is such as to limit deflection of said belt structure.

8. Apparatus according to claim 2 wherein said belt structure comprises a base member fabricated from electroformed nickel.

9. Apparatus according to claim 8 wherein said means for elevating the temperature of said belt structure is positioned relative of said nip so that sufficient time is allowed for elevating the temperature of said belt structure.

10. Apparatus according to claim 9 wherein said means for effecting movement of said belt structure comprises means for effecting rotation of said pressure roll.

11. Printing apparatus comprising:

means for forming toner images on substrates;

a low mass endless belt structure;

means cooperating to form a nip with said belt structure and simultaneously apply pressure to said belt structure;

means remote from said pressure applying means for elevating the temperature of said belt whereby said powder images are simultaneously subjected to heat and pressure as said substrates pass through said nip, said means for elevating the temperature of said belt being in contact with said belt;

means for effecting movement of said belt structure through said nip; and a low mass release agent management system contacting said belt structure for applying release agent material without adversely affecting the fusing capability thereof.

12. Apparatus according to claim 11 wherein said means for elevating the temperature of said belt structure comprises a rotatable low mass tubular member having a source of energy disposed internally thereof.

13. Apparatus according to claim 12 wherein said means cooperating to apply pressure to said belt structure comprises a non-rotating mandrel.

14. Apparatus according to claim 13 including means disposed intermediate said belt structure and said non-rotating mandrel for minimizing the transfer of heat from the former to the latter.

15. Apparatus according to claim 14 wherein the surface of said belt structure contacting said powder images comprises a conformable layer.

16. Apparatus according to claim 15 wherein said belt structure is coated with a low friction material which contacts said non-rotating mandrel and said tubular member.

17. Apparatus according to claim 11 wherein the geometry of the mandrel is such as to limit deflection of said belt structure.

18. Apparatus according to claim 11 wherein said belt structure comprises a base member fabricated from electroformed nickel.

19. Apparatus according to claim 18 wherein said means for elevating the temperature of said belt structure is positioned relative of said nip so that sufficient time is allowed for elevating the temperature of said belt structure.

20. Apparatus according to claim 10 wherein said means for effecting movement of said structure comprises means for effecting rotation of said pressure roll.

21. Apparatus according to claim 1 wherein said low mass tubular member has a thickness of approximately 4 mils.

22. Apparatus according to claim 12 wherein said tubular member has a thickness of approximately 4 mils.

23. Heat and pressure fuser apparatus for fixing toner images to substrates, said apparatus comprising:

means including a heated fuser member for contacting toner images on said substrates;

means contacting said heated fuser member for applying release agent material thereto, said release agent material applying means comprising at least one low mass roll.

24. Apparatus according to claim 23 including a conformable layer on said low mass roll.

25. Apparatus according to claim 23 wherein said low mass roll comprises a core having a thickness approximately equal to 3 mils.

26. Apparatus according to claim 25 wherein said low mass donor roll is electroformed form nickel.

* * * * *